US006511031B2

(12) United States Patent
Lin

(10) Patent No.: US 6,511,031 B2
(45) Date of Patent: Jan. 28, 2003

(54) COFFEE MUG REMOVABLE DOCKING STATION

(76) Inventor: Shin-Shuoh Lin, 27022 Falling Leaf Dr., Laguna Hills, CA (US) 92653

( * ) Notice: Subject to any disclaimer, the term of this patent is extended or adjusted under 35 U.S.C. 154(b) by 8 days.

(21) Appl. No.: 09/764,228

(22) Filed: Jan. 19, 2001

(65) Prior Publication Data

US 2002/0134903 A1 Sep. 26, 2002

(51) Int. Cl.[7] ..... B65D 19/00

(52) U.S. Cl. ..... 248/346.11; 248/205.5; 220/719; D7/533

(58) Field of Search ..... 248/346.11, 205.5, 248/310, 309.3, 309.4; 220/719, 715; D7/533, 536; 206/519

(56) References Cited

U.S. PATENT DOCUMENTS

| | | | | | |
|---|---|---|---|---|---|
| 2,910,219 | A | * | 10/1959 | Bennett et al. | 220/737 |
| 2,910,264 | A | * | 10/1959 | Lindenberger | 248/362 |
| 3,402,844 | A | * | 9/1968 | Chin | 215/393 |
| 4,040,549 | A | * | 8/1977 | Sadler | 224/483 |
| 4,754,888 | A | | 7/1988 | Letch et al. | |
| 4,793,611 | A | * | 12/1988 | Thornell | 473/483 |
| 5,052,643 | A | * | 10/1991 | Law | 248/56 |
| 5,249,703 | A | | 10/1993 | Karp | |
| D346,933 | S | | 5/1994 | Denny et al. | |
| D362,156 | S | | 9/1995 | Goto et al. | |
| D362,369 | S | | 9/1995 | Bridges | |
| D372,838 | S | | 8/1996 | Feltman et al. | |
| D373,051 | S | | 8/1996 | Kramer et al. | |
| D386,948 | S | | 12/1997 | Wissinger | |
| D396,777 | S | | 8/1998 | Inoue | |
| D398,187 | S | | 9/1998 | Parker | |
| D411,713 | S | | 6/1999 | Bridges | |
| 5,918,761 | A | | 7/1999 | Wissinger | |
| D416,757 | S | | 11/1999 | Ginuntoli | |
| 5,984,156 | A | * | 11/1999 | Bridges | 224/566 |
| D425,758 | S | | 5/2000 | Kelly-Pollet | |
| D427,853 | S | * | 7/2000 | Kohlhase | D7/510 |
| 6,089,519 | A | * | 7/2000 | Laybourne | 248/346.11 |

* cited by examiner

*Primary Examiner*—Anita King
(74) *Attorney, Agent, or Firm*—Gordon K. Anderson

(57) ABSTRACT

A removable docking station (20) disposed on a coffee mug or liquid container (22) for increasing surface stability and, when separated, to allow use of the coffee mug or liquid container in a vehicle cup holder. The docking station includes an integral flat base (24) with a cavity (28) on the inside and a number of partial female threads (34) protruding outwardly from vertical walls (30) formed in the cavity. The base is snapped onto the coffee mug or liquid container forming its integral substructure. A docking station body (36) having a bottom larger in surface area than the flat base is configured to mate with the flat base on the container. This body has a top recess (42) with a raised pedestal (46) inside. A number of partial male threads (48) protrude outwardly from the raised pedestal such that when the docking station body is mated with the integral flat base and rotated, the male threads interface with the female threads bring the docking station body into intimate contact with the coffee mug or liquid container locking the body securely to the base. A resilient pad (50) may be attached to the bottom of the body to increase stability of the container on a flat surface such as a table or counter top and the pad also forms a non-slip structure. When used in a vehicle with cup holders, the body is removed and stored in a convenient place.

15 Claims, 3 Drawing Sheets

COFFEE MUG REMOVABLE DOCKING STATION

TECHNICAL FIELD

The present invention relates to removable liquid container bases in general. More specifically to a docking station for a coffee mug permitting the mug to sit on a stationary flat surface and with the capability of being placed in a vehicle cup holder when the station base is removed from the mug.

BACKGROUND ART

Previously, many types of bases have been used in endeavoring to provide an effective means to stabilize a coffee mug or cup when sitting on a flat surface to increase the footprint of the container. In most cases the base is an integral part of the mug or cup and is effective in increasing the stability of the liquid container however is not removable and is therefore limited in its usefulness.

A search of the prior art did not disclose any patents that possess any of the novelty of the instant invention, however the following U.S. patents are considered related:

| U.S. Pat. No. | Inventor | Issue Date |
|---|---|---|
| Des. 346,933 | Denny et al. | May 17, 1994 |
| Des. 362,156 | Goto et al. | Sep 12, 1995 |
| Des. 362,369 | Bridges | Sep 19, 1995 |
| Des. 372,838 | Feltman et al. | Aug 20, 1996 |
| Des. 373,051 | Kramer et al. | Aug 27, 1996 |
| Des. 386,948 | Wissinger | Dec 02, 1997 |
| Des. 396,777 | Inoue | Aug 11, 1998 |
| Des. 398,187 | Parker | Sep 15, 1998 |
| Des. 411,713 | Bridges | Jun 29, 1999 |
| Des. 416,757 | Ginuntoli | Nov 23, 1999 |
| Des. 425,758 | Kelly-Pollet | Dec 21, 1999 |
| Des. 425,758 | Freed | May 30, 2000 |
| 4,754,888 | Letsch et al. | Jul 05, 1988 |
| 5,249,703 | Karp | Sep 05, 1993 |
| 5,918,761 | Wissinger | Jul 06, 1999 |

Letsch et al. in U.S. Pat. No. 4,754,888 discloses a carafe with an inner container surrounded by a casing. The inner container and the casing have an opening at the top which may be closed by a separate plug. The plug and opening in the container and casing are shaped such that it is possible to fill or empty the inner container while the plug is still in the opening. The plug and container both have mating grooves that provide opposed flow paths into and out of the container. The container also includes a basin around the top for receiving coffee from a coffee maker and the plug has openings to provide a flow path from the basin into the container interior.

Karp in U.S. Pat. No. 5,249,703 teaches a travel mug that includes a container and a lid in combination. The container has a handle and an annular lip that has an annulus capable of forming a seal with the top side of the annular lip. A cylindrical well in the lid has a vertical dividing wall such that the lid may be readily rotated by hand. The retaining arms extend from the underside of the lid and engage the underside of the annular lip to pull it into tight abutment. Diametrically opposed gaps in the lip act as passageway for the retaining arms. Similarly diametrically opposed notches in the lid align with the gaps to allow liquid to be poured from the container.

U.S. Pat. No. 5,918,761 issued to Wissinger is for an insulated container and cover combination that has an outer container shell terminating at an opening with a surrounding edge. An inner container shell is nested within the outer container shell and has an opening surrounded by a continuous edges in abutment with the surrounding edge. The inner container shell is spaced inwardly and is out of contact with the outer shell. A cover mounting assembly is attached to the outer shell adjacent to the opening. A single seal, made of elastomeric material, has a sealing surface disposed at the interface of the shells. Locating rings define the removable cover mounting assembly and locate the single sealing ring on the inner and outer shells.

For background purposes and as indicative of the art to which the invention is related reference may be made to the remaining cited design patents.

DISCLOSURE OF THE INVENTION

It has been the trend in automobile manufacture to include cup holders in convenient locations within the interior of a vehicle for accessibility of the driver and passengers to retain a cold beverage or a cup of coffee within arms reach. This direction has escalated to include cup holders not only in the front seat but also within the entire interior of the vehicle some of which are stationary and others that retract when not in use. In most cases the cup holders are sized to handle a common soft drink container or a small cup of coffee which its basic diameter is almost universal throughout the world. Another trend has been to increase the capacity of the beverage container, therefore, in order to maintain accommodation in the cup holders the container must have a smaller base and be taller and larger in diameter at the top. This configuration presents a problem in that the vessel, either a coffee cup or cold beverage container, becomes unstable as the top, being larger, creates an unbalanced situation making it top heavy and susceptible to tipping with only slight contact or impact when the vessel is placed on a flat surface. It is therefore a primary object of the invention to utilize a removable docking station in the form of a base, integral with the container, which has a threaded cavity in the center and a docking station body with mating threads connected thereunto. This combination permits the best of both worlds in that when the coffee mug or liquid container is used on a flat surface it is substantially stable and yet when the docking station is removed it fits easily into vehicle cup holders.

An important object of the invention is that when the docking station is used in conjunction with the modern insulated stainless steel coffee mugs the combination becomes extremely stable on a desk top or table as the base is large enough to spread the weight evenly over a liberal area. This stability is extremely important as it is common to place a coffee mug in close proximity to keyboards, papers and work surfaces where coffee spills could be catastrophic.

Another object of the invention is seen when the docking station is removed, since the mug itself is unaffected in its utility and the bottom portion is specifically sized to fit almost all conventional cup holders in a wide variety of motor vehicles. The preferred embodiment of the invention is integrated into a double walled insulated coffee mug having a bottom diameter the same as a soda pop can which extends its adaptability to even the oldest vehicles having cup holders. Many newer motor vehicles have holders that are stepped larger to accommodate large coffee and beverage cups however they almost always continue to fit the typical conventional can configuration.

Still another object of the invention is noted when the docking station is attached, as it has the same basic design as the balance of the mug and is made of the same material as the top, therefore, not only is there no adverse effect on its appearance but it may be easily used without removal. The design is so ingenuous that it appears to be a integral part of the mug to the casual observer.

Yet another object of the invention is that the docking station may be removed easily by twisting in less than a full rotation. It is preferred that the threads permit complete engagement in essentially 180 degrees of rotation which is easily accomplished or in another embodiment only a quarter turn is required permitting complete attachment without repositioning either hand.

A further object of the invention is that the docking station may contain a resilient non-skid pad that grips the surface upon which the coffee mug or liquid container rests. This pad is a simple thin disc of rubber-like material held in place with pressure sensitive adhesive centrally positioned on the bottom of the docking station base.

A final object of the invention is its adaptability to almost any type of liquid container such as the aforementioned coffee mug with the liquid container used for soft drinks, water, soups, tea, hot chocolate and the like.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
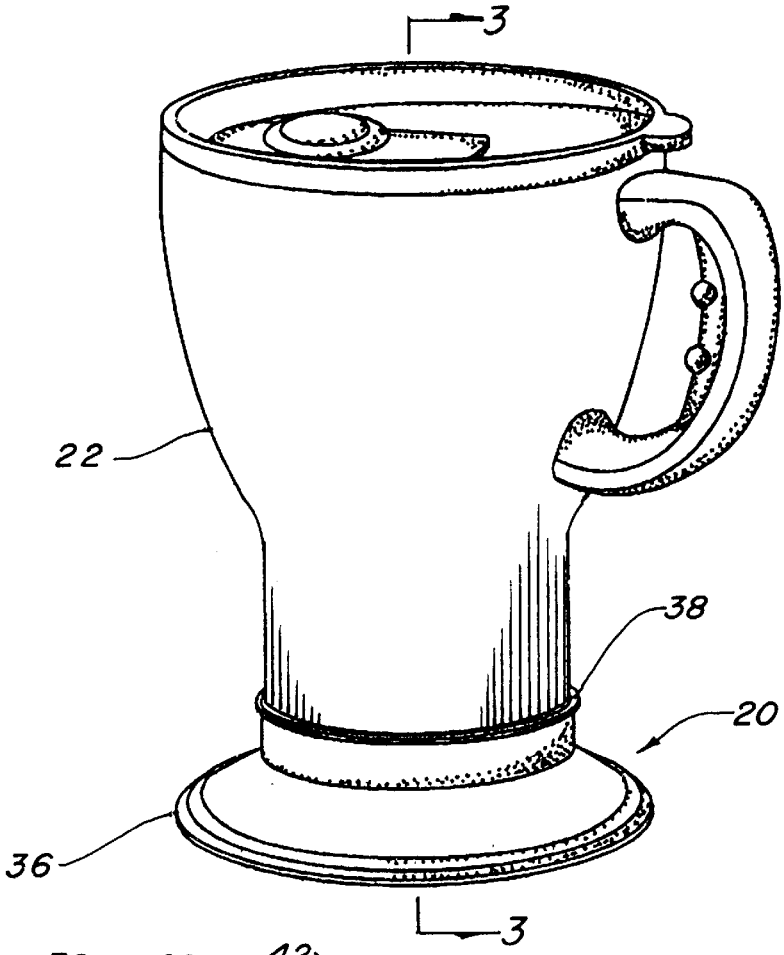
FIG. 1 is a partial isometric view of the preferred embodiment of the docking station attached to a coffee mug.
Figure 2:
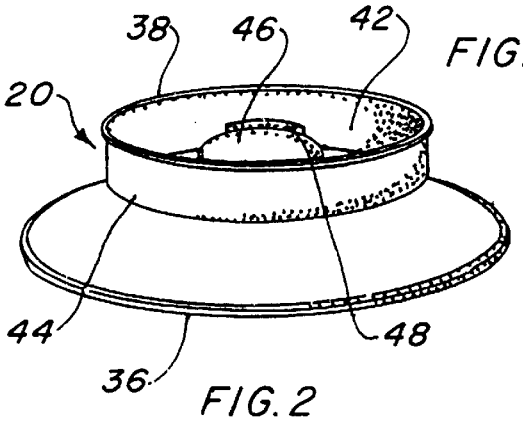
FIG. 2 is a partial isometric view of the preferred embodiment of the docking station shown by itself, removed from the coffee mug.

The best mode for carrying out the invention is presented in terms of a preferred embodiment. This preferred embodiment is shown in FIGS. 1 thorough 14 and is comprised of a removable docking station 20 for a coffee mug or liquid container 22 to increase the bottom surface area stability and to allow its use in a vehicle cup holder when separated. The coffee mug or liquid container 22 has an integral flat base 24 as illustrated in FIGS. 4 through 8 and is formed of a thermoplastic material such as polycarbonate, polyethylene, polyimide, polystyrene, polypropylene, polysulfone, polyurethane or ethylene-vinyl-acetate. The integral flat base 24 preferably snaps in place onto the coffee mug or liquid container 22 for its retention as the material is resilient enough to permit this type of fastening means.

The coffee mug or liquid container 22 is preferably the dual wall insulated stainless steel type of construction, as illustrated, since it is ideal for applying this unique docking station 20. It is not to be construed however, as the only type of container construction, as almost any type of mug, cup, tumbler or liquid retaining vessel may be used with equal ease. Regardless of the type of fabrication of the liquid container 22 the flat base 24 must be integrally formed with the containers bottom surface and its outside diameter must be essentially equal to the outside diameter of a conventional soft drink beverage can. Since the container is made of a different material and is added at a different point in the construction, it is best for the integral flat base 24 to include a weep hole 26 through its bottom surface to prevent condensation build-up between the base and the coffee mug or liquid container within the dead air space between the two elements. The flat base 24 is considered to be integral as it forms the bottom of the vessel and has the same outside shape even though it is of a different material and is preferably snapped into place during the manufacturing process.

The integral flat base 24 has a cavity 28 centrally located on the bottom as shown in FIGS. 4, 5, 7 and 8, which includes, vertical walls 30 and a horizontal internal seat 32 which is parallel to the bottom surface of the base. A plurality of partial female threads 34 depend outwardly from the vertical walls 30 of the cavity 28, as illustrated. The threads are considered to be partial as they do not continue completely around the cavities vertical walls 30 but are sectioned appositely on each side. The partial female threads 34 may be either the tapered thread type or a square thread commonly known as acme threads.

Figure 3:
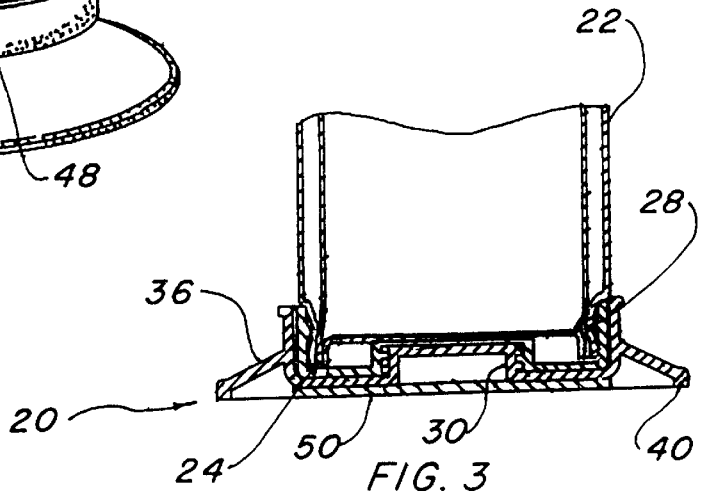
FIG. 3 is a cross sectional view taken along lines 3—3 of FIG. 1.
Figure 4:
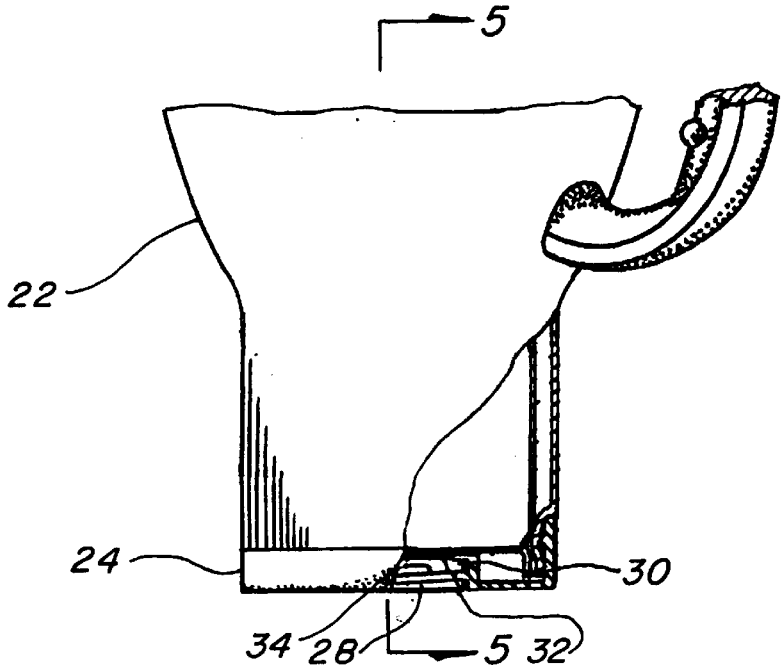
FIG. 4 is a cut away partial front view of the coffee cup with the integral base snapped into place.
Figure 5:
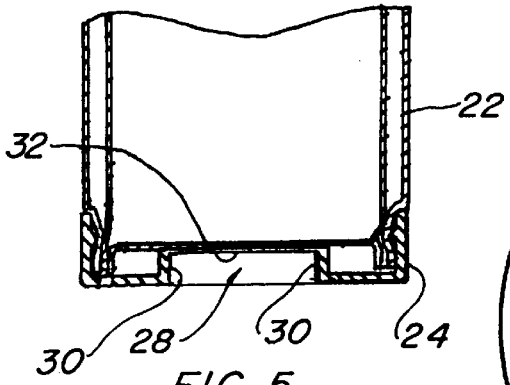
FIG. 5 is a cross sectional view taken along lines 5—5 of FIG. 4.
Figure 6:
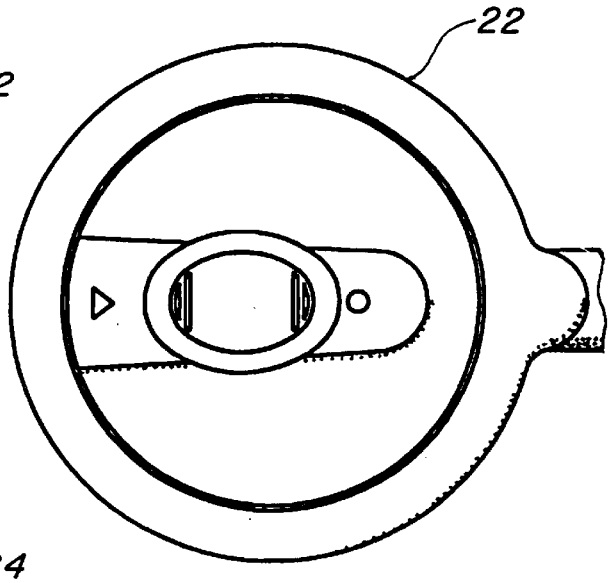
FIG. 6 is a top view of the coffee cup.
Figure 7:
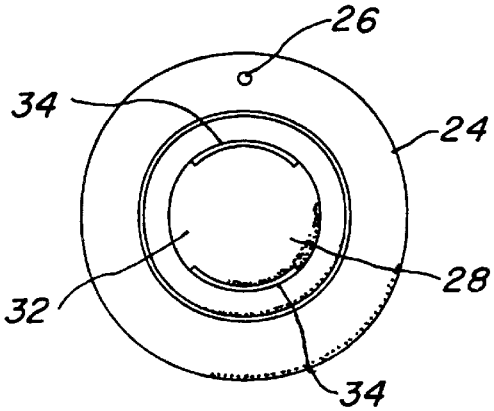
FIG. 7 is a bottom view of the coffee cup with the integral base snapped into place.
Figure 8:
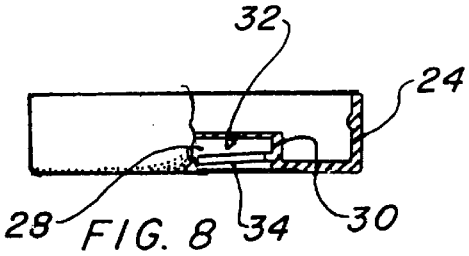
FIG. 8 is a cut away side view of the integral base shown removed from the coffee cup.
Figure 9:
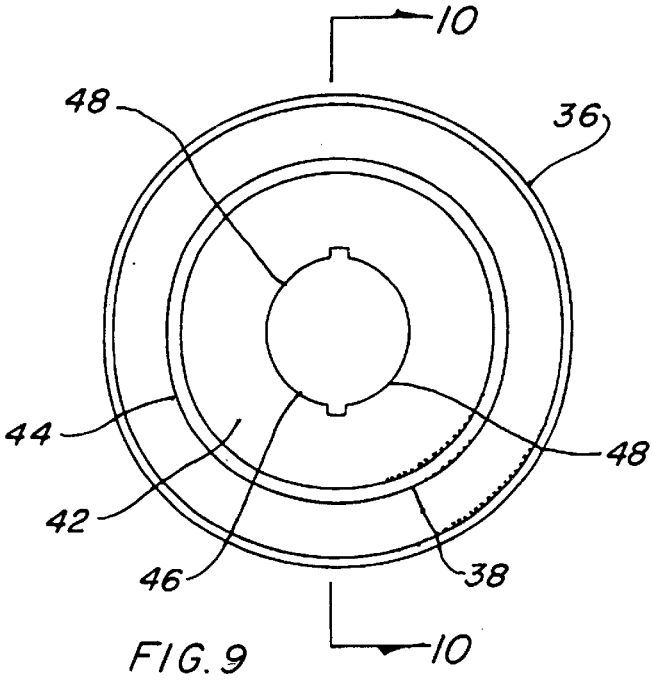
FIG. 9 is top view of the docking station body completely removed from the invention for clarity.
Figure 10:
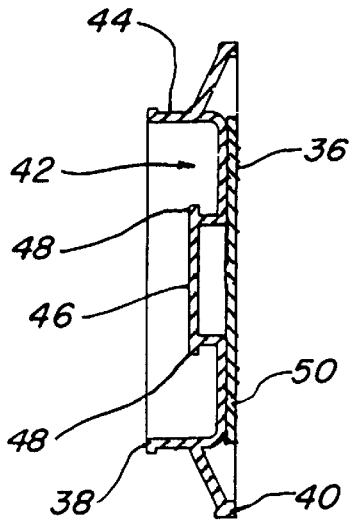
FIG. 10 is a cross sectional view taken along lines 10—10 of FIG. 9.
Figure 11:
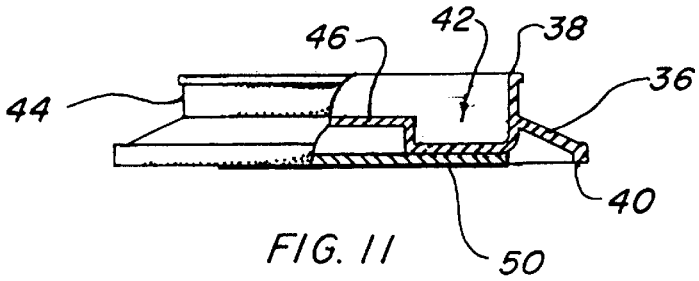
FIG. 11 is a cross sectional view taken along lines 11—11 of FIG. 9.
Figure 12:
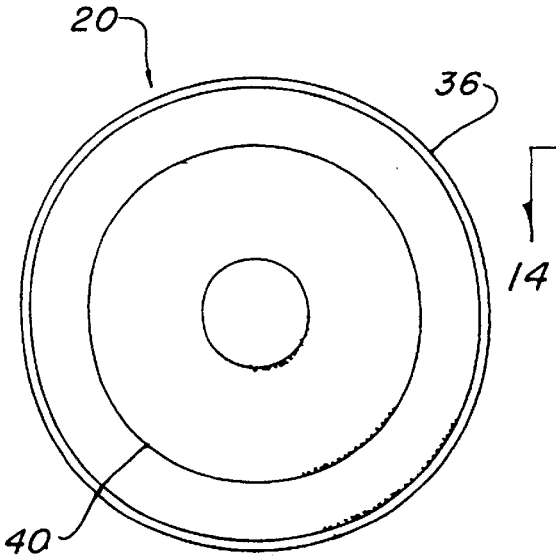
FIG. 12 is bottom view of the docking station body completely removed from the invention for clarity.

The removable portion of the invention consists of a docking station body 36 that includes a top 38 and a bottom 40 as depicted in FIGS. 9 through 14. The docking station bottom 40 is larger in surface area than the integral flat base 24, as illustrated in FIGS. 1 and 3. It has been found that the ideal relationship of the size of the bottom 40 is from 1.5 to 1.75 times larger than that of the integral flat base 24, which permits optimum stability of the container, even when the vessel is relatively tall. The docking station body 36 is also formed of a thermoplastic material, the same as the flat base 24, which includes a choice of polycarbonate, polyethylene, polyamide, polystyrene, polypropylene, polysulfone, polyurethane or ethylene-vinyl-acetate and the like.

The docking station body 36 has a recess 42 formed within its top 38 that includes an elevated peripheral lip 44 sized to fit over and enclose the integral flat base 24. FIG. 3 illustrates this relationship and the height of the lip 44 is preferred , but not mandatory, to be from 0.23 to 0.24 times the outside diameter of the integral flat base 24. By extending the lip 44 upwards to cover the base 24 entirely, when mated together, the docking station body 36 visually appears to be the base itself and blends in with the aesthetic profile of the coffee mug.

A raised pedestal 46 is formed within the recess 42 of the docking station body 36 and is configured to mate with the cavity 28 within the flat base 24. A plurality of partial male threads 48 depend outwardly from the raised pedestal 46 and are configured to mate with the female threads 34 on the flat base 24. The male threads 48 are the same basic type as the female threads 34 discussed previously.

When the docking station body 36 is mated with the integral base 24 and rotated, the male threads 48 interface with the cavity female threads 34 bringing the pedestal 46 into intimate contact with the cavity internal seat 32, thus fastening the docking station body 36 to the base 24 of the coffee mug or liquid container 22 in a removable manner. In order to make the removal of the docking station body 36 from the base 24 easy and convenient, the mating threads are omitted in opposed radial areas to allow the connection to be made with the minimum of rotation. It has been found that two approaches accomplish this end result, with the first requiring rotation to bring the pedestal 46 into intimate contact with the cavity internal seat 32 of from 90 to 360 degrees and the second requiring rotation of from 45 to 90 degrees. This operational procedure is accomplished by the specific location and space between the threads and obviously the pitch of the threads themselves.

Figure 13:
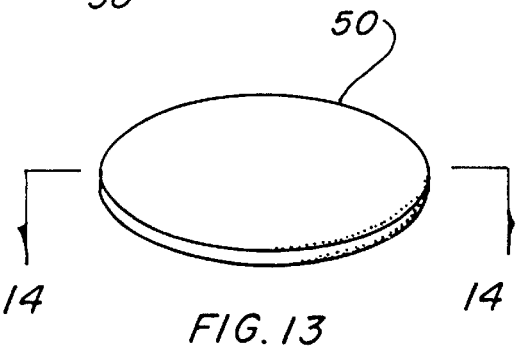
FIG. 13 is a partial isometric view of the resilient pad completely removed from the invention for clarity.
Figure 14:
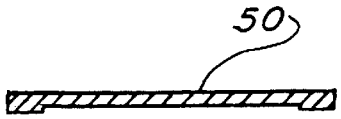
FIG. 14 is a cross sectional view taken along lines 14—14 of FIG. 13.

A resilient pad 50, shown in FIGS. 13 and 14, may optionally attached to the docking station body bottom 40 for increasing stability of the body on a flat surface such as a table or counter top. The pad 50 may be attached with pressure sensitive adhesive, or the like, and forms a non-slip substructure.

As stated previously the docking station 20 may remain on the liquid container during use or if it is to be utilized in a vehicle, the body 36 is simply removed by twisting it off by hand and stored in a convenient location. It should also be noted that when the station body 36 is removed the base 24 is large enough to be as stable as any soft drink can as it is the same diameter and has the same bottom configuration.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

What is claimed is:

1. A removable docking station for a coffee mug or liquid container for increasing bottom surface area stability and allowing use in a vehicle cup holder when separated, the docking station comprising:

a coffee mug or liquid container having an integral flat base, said base having a cavity within, which includes, vertical walls and a horizontal internal seat parallel to the base, a plurality of partial female threads depending outwardly from the vertical walls of the cavity, a docking station body having a top and a bottom, with said bottom larger in surface area than the integral flat base, said docking station body having a recess formed within the top, including an elevated peripheral lip sized to fit over and enclose the integral flat base, a raised pedestal within the recess of the docking station body, and a plurality of partial male threads depending outwardly from the body raised pedestal, such that when the docking station body is mated with the integral base and rotated, the male threads interface with the cavity female threads bringing the pedestal into intimate contact with the cavity seat, thus fastening the docking station body to the base of the coffee mug or liquid container in a removable manner.

2. The removable docking station as recited in claim 1 wherein said integral flat base is formed of a thermoplastic material selected from a group consisting of polycarbonate, polyethylene, polyamide polystyrene, polypropylene, polysulfone, polyurethane, and ethylene-vinyl-acetate.

3. The removable docking station as recited in claim 1 wherein said integral flat base further comprising an outside diameter essentially equal to a conventional soft drink beverage can outside diameter.

4. The removable docking station as recited in claim 1 wherein said partial male and female threads further comprise tapered threads.

5. The removable docking station as recited in claim 1 wherein said partial male and female threads further comprise square acme threads.

6. The removable docking station as recited in claim 1 wherein said partial male and partial female threads require rotation, to bring the pedestal into intimate contact with the cavity seat, of from 90 to 360 degrees.

7. The removable docking station as recited in claim 1 wherein partial male and partial female threads require rotation, to bring the pedestal into intimate contact with the cavity seat, of from 45 to 90 degrees.

8. The removable docking station as recited in claim 1 wherein said bottom surface area of the docking station body is from 1.5 to 1.75 times larger than that of the integral flat base.

9. The removable docking station as recited in claim 1 wherein said docking station body is formed of a thermoplastic material selected from a group consisting of polycarbonate, polyethylene, polyamide polystyrene, polypropylene, polysulfone, polyurethane, and ethylene-vinyl-acetate.

10. The removable docking station as recited in claim 1 wherein said docking station body elevated peripheral lip height is from 0.23 to 0.24 times the outside diameter of the integral flat base.

11. The removable docking station as recited in claim 1 further comprising a resilient pad attached to the docking station body bottom for increasing stability of the body on a flat surface including a table and a counter top and forming a non-slip substructure.

12. A removable docking station for a coffee mug or liquid container for increasing bottom surface area stability and allowing use in a vehicle cup holder when separated, the docking station comprising:

a coffee mug or liquid container having an integral flat base, said coffee mug or liquid container further comprises dual wall insulated stainless steel construction, said base having a cavity within, which includes, vertical walls and a horizontal internal seat parallel to the base, a plurality of partial female threads depending outwardly from the vertical walls of the cavity, a docking station body having a top and a bottom, with said bottom larger in surface area than the integral flat base, said docking station body having a recess formed within the top, including an elevated peripheral lip sized to fit over and enclose the integral flat base, a raised pedestal within the recess of the docking station body, and a plurality of partial male threads depending outwardly from the body raised pedestal, such that when the docking station body is mated with the integral base and rotated, the male threads interface with the cavity female threads bringing the pedestal into intimate contact with the cavity seat, thus fastening the docking station body to the base of the coffee mug or liquid container in a removable manner.

13. A removable docking station for a coffee mug or liquid container for increasing bottom surface area stability and allowing use in a vehicle cup holder when separated, the docking station comprising:

a coffee mug or liquid container having an integral flat base, wherein said integral flat base snaps in place onto the coffee mug or liquid container for retention therewith;

said base having a cavity within, which includes, vertical walls and a horizontal internal seat parallel to the base, a plurality of partial female threads depending outwardly from the vertical walls of the cavity, a docking station body having a top and a bottom, with said bottom larger in surface area than the integral flat base, said docking station body having a recess formed within the top, including an elevated peripheral lip sized to fit over and enclose the integral flat base, a raised pedestal within the recess of the docking station body, and a plurality of partial male threads depending outwardly from the body raised pedestal, such that when the docking station body is mated with the integral base and rotated, the male threads interface with the cavity female threads bringing the pedestal into intimate contact with the cavity seat, thus fastening the docking station body to the base of the coffee mug or liquid container in a removable manner.

14. A removable docking station for a coffee mug or liquid container for increasing bottom surface area stability and allowing use in a vehicle cup holder when separated, the docking station comprising:

a coffee mug or liquid container having an integral flat base, wherein said integral flat base further having a weep hole therethrough to prevent condensation build-up between the base and the coffee mug or liquid container, said base having a cavity within, which includes, vertical walls and a horizontal internal seat parallel to the base, a plurality of partial female threads depending outwardly from the vertical walls of the cavity, a docking station body having a top and a bottom, with said bottom larger in surface area than the integral flat base, said docking station body having a recess formed within the top, including an elevated peripheral lip sized to fit over and enclose the integral flat base, a raised pedestal within the recess of the docking station body, and a plurality of partial male threads depending outwardly from the body raised pedestal, such that when the docking station body is mated with the integral base and rotated, the male threads interface with the cavity female threads bringing the pedestal into intimate contact with the cavity seat, thus fastening the docking station body to the base of the coffee mug or liquid container in a removable manner.

15. A removable docking station for a coffee mug or liquid container for increasing surface stability and allowing use in a vehicle cup holder when separated, the docking station comprising:

a coffee mug or liquid container including an integral flat base having a cavity within and a plurality of partial female threads depending outwardly from vertical walls of the cavity, wherein said coffee mug or liquid container further comprises dual wall insulated stainless steel construction, a docking station body having a bottom larger in surface area than the flat base, said body further having a top recess including a raised pedestal within, wherein said integral flat base along with the docking station body are formed of a thermoplastic material selected from a group consisting of polycarbonate, polyethylene, polyamide, polystyrene, polypropylene, polysulfone, polyurethane, and ethylene-vinyl-acetate, and a plurality of partial male threads depending outwardly from the raised pedestal, such that when the docking station body is mated with the integral flat base and rotated, the male threads interface with the female threads bringing the docking station body into intimate contact with the coffee mug or liquid container, in a removable manner.

* * * * *